United States Patent [19]

Priede

[11] Patent Number: 4,722,690

[45] Date of Patent: Feb. 2, 1988

[54] CLOCK SPRING INTERCONNECTOR

[75] Inventor: Lorenz H. Priede, Valparaiso, Ind.

[73] Assignee: Methode Electronics, Inc., Chicago, Ill.

[21] Appl. No.: 27,010

[22] Filed: Mar. 17, 1987

[51] Int. Cl.[4] ..... H01R 35/00

[52] U.S. Cl. ..... 439/15

[58] Field of Search ..... 439/1, 11, 13, 15

[56] References Cited

U.S. PATENT DOCUMENTS

| | | | |
|---|---|---|---|
| 3,525,536 | 8/1976 | Pruneski | 439/15 |
| 3,763,455 | 10/1973 | Confer et al. | 439/15 |
| 4,417,775 | 11/1983 | Sakurai et al. | 439/15 |
| 4,422,699 | 12/1983 | Sakurai et al. | 339/35 |
| 4,451,105 | 5/1984 | Sakurai et al. | 339/35 |
| 4,607,898 | 8/1986 | Reighard et al. | 339/35 |

*Primary Examiner*—John McQuade

*Attorney, Agent, or Firm*—Charles F. Pigott, Jr.

[57] ABSTRACT

A clock spring interconnector provides electrical connection between a rotating and nonrotating electrical circuit. In the interconnector, an outer housing defines a fist aperture extending therethrough. A rotor member occupies the first aperture in rotational relation to it. First conductor wire means are carried by the outer housing, while second conductor wire means are carried by the rotor member. Coiled conductor means are loosely coiled in a plurality of coils about the rotor member within the outer housing, with the coiled conductor means being connected at respective ends to the first and second conductor wires. The rotor member defines a second aperture extending through it in generally coaxial relation with the first aperture. In accordance with this invention, at least a part of the second aperture is of noncircular cross-section, with the outer housing defining a portion projecting into the noncircular part of the second aperture, to limit the rotation of the rotor member to provide rotational orientation of it until the projecting portion is removed.

8 Claims, 4 Drawing Figures

FIG. 1
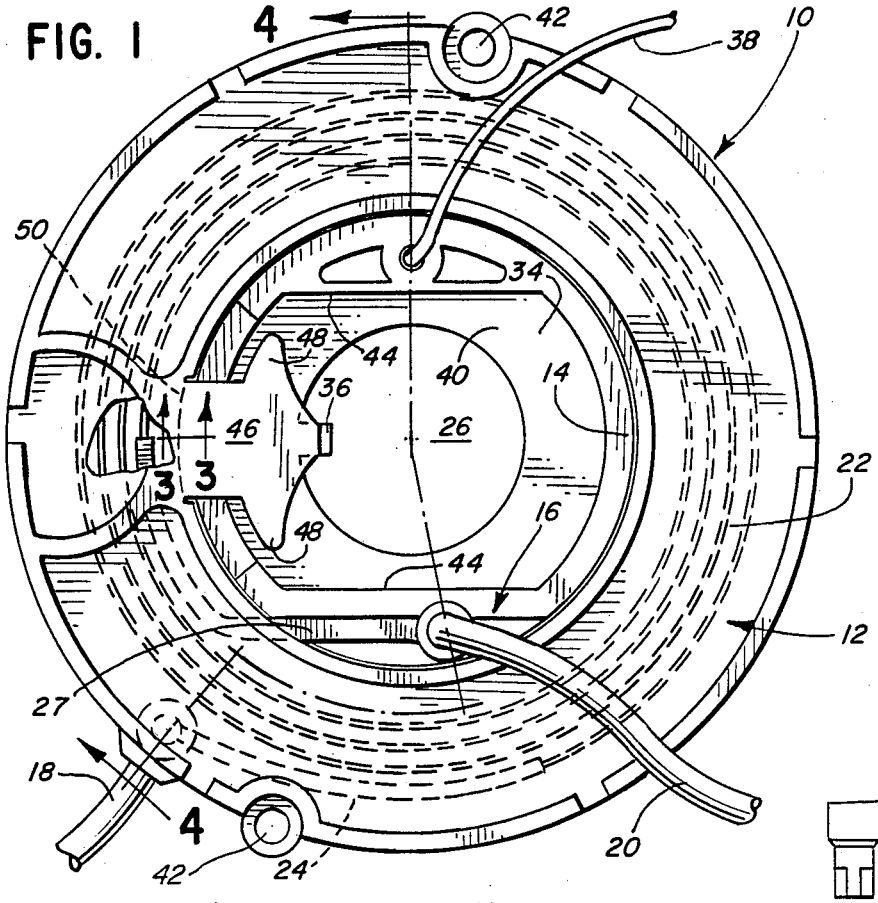
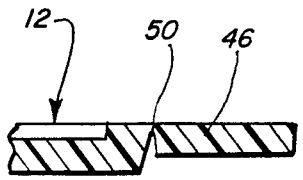
FIG. 3
FIG. 2
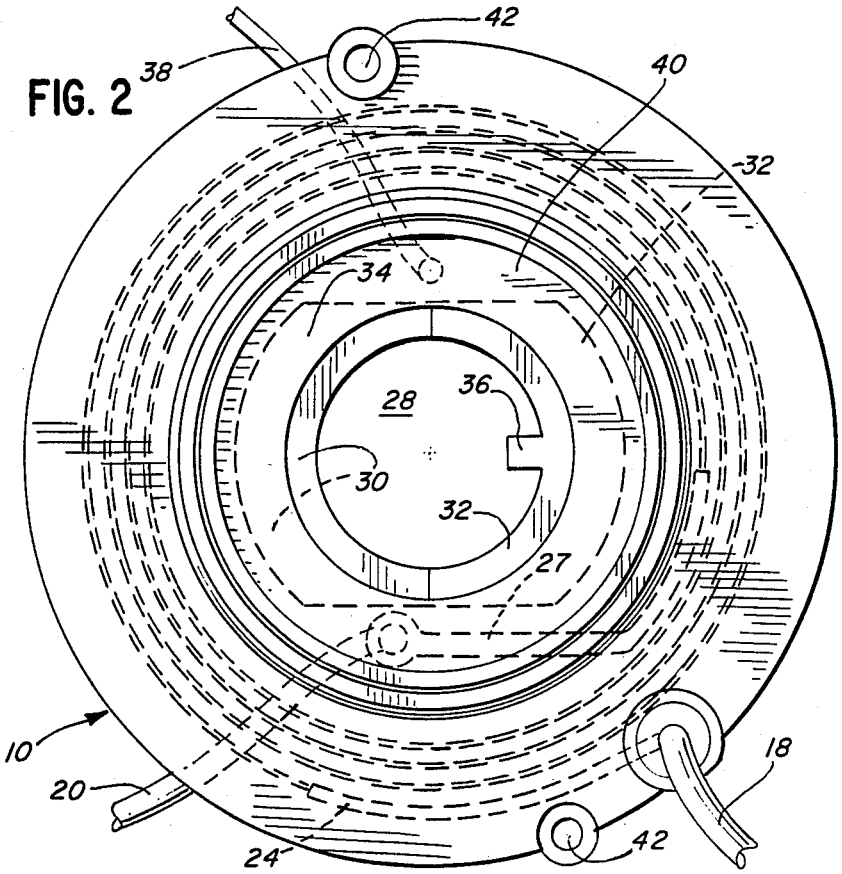
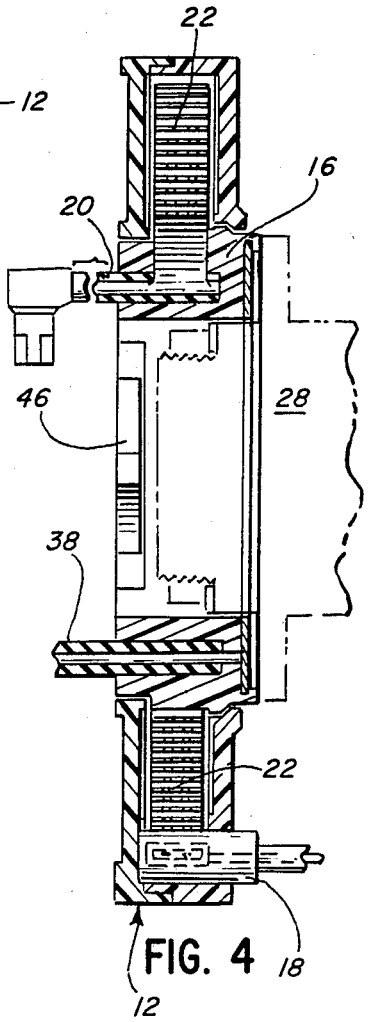
FIG. 4

CLOCK SPRING INTERCONNECTOR

BACKGROUND OF THE INVENTION

The invention of this application relates to an electrical connection member which provides positive electrical connection, without moving or sliding parts, between a portion of an electrical circuit which is rotatable and a circuit portion which is stationary.

In the new automobile technology for air bags, an air bag assembly which is mounted on the steering column must be in electrical connection with sensors or the like to provide an electrical signal that instantly activates the air bag in the event of a crash, causing the air bag to inflate to protect the car occupant.

Accordingly, there is a need for an electrical connection between the rotatable portion of the air bag assembly which is mounted on the steering column, and the rest of the system which is stationery. Electrical connections between rotatable and stationery parts are of course well known. Typically, an electrical brush rests upon a conductive ring, with one of the parts being rotatable to provide such rotatable electrical connection. However, there is a risk, particularly during the impact of an accident, of a transient failure of electrical connection with a brush and ring system, which would result in failure of the entire air bag system.

Accordingly, a clock spring interconnector has been previously developed, comprising an outer housing and an inner rotor member, each connected with conductor wires, and a conductor coiled in a plurality of coils about the rotor within the outer housing and connected to each of the conductor wires. By this means, the interconnector may be mounted on the steering column, and the steering wheel may be rotated in either direction while a continuous, positive electrical connection is provided between the two conductor wires through the coiled conductor.

While this system is effective to provide the necessary continuous electrical connection between an air bag or other device on a rotating column and a stationary part of the circuit, the design of prior art clock spring interconnectors has been lacking in that they are relatively expensive and cumbersome. Specifically, a large extra snap piece has been previously used to lock the housing and rotor together, constituting an extra and unnecessary part. There also is a need to position the rotor in a predetermined rotational position during installation of the interconnector on the steering column. The reason for this is that, if the rotor moves out of its predetermined position, it may not be possible to turn the steering wheel of the car about its full range of travel from left to right without coming to an end of the ability of the interconnector to rotate without breaking the coiled conductor. Thus, the interconnector must be installed on the steering column at a predetermined angular position, so that it and the steering wheel may be rotated both to the left and right in the full direction of travel. Typically, an interconnector may be capable of rotating two and one-half revolutions either clockwise or counterclockwise from the central position in which it is installed on the steering column while the wheels of the vehicle are straight.

By this invention, a clock spring interconnector of simplified design is provided in which the cumbersome extra part for retention of the interconnector can be eliminated. At the same time, means are provided for maintaining the desired angular orientation of the interconnector of this invention without the need for an extra part above and beyond the outer housing and rotor.

DESCRIPTION OF THE INVENTION

The invention relates to a clock spring interconnector comprises an outer housing defining a first aperture extending therethrough. A rotor member occupies the first aperture in rotational relation to it. First conductor wire means is carried by the outer housing, while second conductor wire means is carried by the rotor member. A coiled conductor means is loosely coiled in a plurality of coils about the rotor member within the outer housing, with the coiled conductor means being connected at respective ends thereof to the first and second conductor wire means. The rotor member defines a second aperture extending through it in generally coaxial relation with the first aperture, for example to permit installation of the interconnector on a steering column.

In accordance with this invention, at least a part of the second aperture is of noncircular cross-section. Specifically, this noncircular cross-section may include a pair of opposed, straight walls. The outer housing defines a portion which projects into the noncircular part of the second aperture, to limit the rotation of the rotor member to provide the desired rotational orientation of it until the projecting portion is removed.

For example, the projecting portion may define a pair of opposed, laterally extending members for contacting the noncircular periphery of the second aperture cross-section. Accordingly, in the case where the noncircular cross-section has opposed, straight walls, rotation may be limited by impingement of the contact members against the straight walls.

Additionally, means may be provided, such as a line of breaking weakness, to the projecting portion to facilitate its breaking away from the outer housing after insulation of the interconnector on a steering column or the like.

Preferably, the rotor member is capable of rotating at least two complete turns in either direction from a central rotational position when the projecting portion is removed. The projecting portion may project inwardly from the periphery of the first aperture, and a line of breaking weakness may be defined in the projecting portion adjacent the remainder of the periphery of the first aperture, to permit removal of the projecting portion from the periphery.

Accordingly, the clock spring interconnector of this invention may be installed on a steering column or the like without the installer having to pay attention to the angular orientation of the rotor. Then, when the interconnector has been so installed, the projecting portion is simply broken away with the fingers, a screwdriver, or the like, and the interconnector is then ready for use to provide electrical connection under conditions of extreme stress (i.e., an auto crash) to carry the electric signal that activates an air bag or the like under such circumstances.

It is to be understood that the clock spring interconnector of this invention is not to be necessarily limited to use in conjunction with an air bag, or limited to mounting on the steering column of a vehicle. It is contemplated that other uses for the device are readily determinable by those skilled in the art.

DESCRIPTION OF THE DRAWINGS

In the drawings,

FIG. 1 is an elevational view of one side of the clock spring interconnector of this invention;

FIG. 2 is an elevational view of the other side of the interconnector of this invention;

FIG. 3 is a sectional view taken along line 3—3 of FIG. 1; and

FIG. 4 is a sectional view taken along line 4—4 of FIG. 1.

DESCRIPTION OF SPECIFIC EMBODIMENT

Referring to the drawings, clock spring interconnector 10 is shown. The phrase "clock spring" is not necessarily intended to be literally interpreted, but refers generally to any coiled conductor means loosely coiled in a plurality of coils about the rotor member as described above.

As shown in the drawings, outer housing 12 defines a first aperture 14 extending through it. Rotor member 16 occupies first aperture 14 in rotational relation thereto. First conductor wire 18 is carried by outer housing 12, while second conductor wire 20 is carried by rotor member 16.

A coil of flat, insulated wire 22, preferably containing two parallel separate conductors, is loosely coiled in a plurality of coils about rotor member 16 within outer housing 12. Coil 22 is connected at one end to first conductor member 18 by means of stiff, arcuate connector 24, while conductor 20 connects with coil 22 at its other end by means of stiff connector 27, so that electrical signals can continuously pass through coil 22 between conductors 18, 20.

Rotor 16 defines second aperture 26 extending through it in generally coaxial relation with first aperture 14. This permits the mounting of clock spring interconnector 10 on a steering column 28 as shown in FIG. 2. To accomplish this purpose, a pair of shaped plates 30, 32 are brought together about steering column 28 to collectively form a washer member. This washer member formed by plate members 30, 32 can be seen to be of the same shape as recess 34, shown in full lines in FIG. 1. Accordingly, the washer may be assembled out of plates 30, 32 about shaft 28, and then dropped into recess 34, for retention of the clock spring connector 10 on shaft 28. Plate 32 is shown to have a key 36 which can fit into a corresponding keyway of shaft 28.

Third wire 38 is shown to be in connecting relation with conductive ring 40, which may serve as part of the electrical circuit system for the horn, to transfer signals from the horn control on the steering column to the stationary horns mounted under the hood, with the signal being picked up from conductive ring 40 by a conventional brush connector.

Accordingly, it can be seen that rotor 16 can rotate a considerable distance in either direction, depending upon the number of coils and degree of looseness of conductor coils 22, while the electrical connection between conductors 18 and 20 remains intact.

Attachment members 42 are provided to permit housing 12 to be immovably bolted to a frame surrounding the steering column.

In accordance with this invention, at least part of the periphery of second aperture 26 (i.e., recess 34) is of noncircular cross-section. Specifically, the noncircular cross-section is defined by opposed, straight walls 44, defined by rotor 16. It has already been stated that the plates 30, 32 surrounding steering column 28 may drop into this recess and are of a shape corresponding to it. Additionally, outer housing 12 defines a projecting portion 46 which projects into the noncircular recess 34 of second aperture 26. This has the effect of limiting the rotation of rotor member 16. Specifically, projecting portion 46 may define a pair of opposed, laterally projecting contact members 48. It can be seen that as rotor member 16 rotates in first aperture 14, one or the other of the straight walls 44 will quickly impinge against one of the laterally projecting contact members 48 to prevent further rotation, until projecting portion 46 is removed. Thus, the clock spring connector 10 may be mounted in a routine, assembly line manner as previously described, with the assurance that no significant rotation of rotor member 16 will take place as the interconnector 10 is mounted onto steering column 28. This assures that the interconnector 10 will have a range of rotational travel that corresponds with the range of rotational travel of steering column 28, for full operation of the system.

After interconnector 10 has been mounted on steering column 28, laterally extending member 46 may be broken away by bending it upwardly to cause rupturing of line of weakness 50, which, as shown, may be a thin spot in the structure. Upon removal of member 46, rotor 16 of the interconnector is free to rotate freely with steering column 28.

Both housing 12 and rotor 16 may be molded of an appropriate plastic material, for example polystyrene or the like, with projecting member 46 being an integrally molded part of housing 12. Thus, an extra, large part used in the prior art is eliminated by the simple and inexpensive modification of this invention.

Housing 12 may be conventionally manufactured out of a pair of housing halves such as a top and a lid which, in turn, may be either heat sealed or solvent sealed together to enclose rotor 16 and coil 22.

The above has been offered for illustrative purposes only, and is not intended to limit the scope of the invention of this application, which is as defined in the claims below.

That which is claimed is:

1. In a clock spring interconnector which comprises: an outer housing defining a first aperture extending therethrough; a rotor member occupying said first aperture in rotational relation thereto; first conductor wire means carried by said outer housing; second conductor wire means carried by said rotor member; and coiled conductor means loosely coiled in a plurality of coils about said rotor member within said outer housing, said coiled conductor means being connected at respective ends thereof to said first and second conductor wire means; said rotor member defining a second aperture extending therethrough in generally coaxial relation with the first aperture, the improvement comprising, in combination:

at least a part of said second aperture being of noncircular cross-section, said outer housing defining a portion projecting into said noncircular part of the second aperture to limit the rotation of said rotor member to provide rotational orientation of said rotor member until said portion is removed.

2. The interconnector of claim 1 in which means are provided to facilitate breaking away of said projecting portion from the outer housing.

3. The interconnector of claim 1 in which said projecting portion defines a pair of opposed, laterally extending contact members and said second aperture noncircular cross-section includes a pair of opposed, straight walls, whereby said rotation is limited by impingement of said contact members against said straight walls.

4. The interconnector of claim 1 in which said rotor member is capable of rotating at least two complete turns in either direction from a central rotational position when said projecting portion is removed.

5. The interconnector of claim 1 in which said projecting portion projects inwardly from the periphery of said first aperture, and a line of breaking weakness being defined in said projecting portion adjacent the remainder of said periphery to permit removal of said projecting portion from said periphery.

6. In a clock spring interconnector which comprises: an outer housing defining a first aperture extending therethrough; a rotor member occupying said first aperture in rotational relation thereto; first conductor wire means carried by said outer housing; second conductor wire means carried by said rotor member; and coiled conductor means loosely coiled in a plurality of coils about said rotor member within said outer housing, said coiled conductor means being connected at respective ends thereof to said first and second conductor wire means; said rotor member defining a second aperture extending therethrough in generally coaxial relation with the first aperture, the improvement comprising, in combination:

at least part of said second aperture being of noncircular cross-section, said outer housing defining a portion projecting into said noncircular part of the second aperture to limit the rotation of said rotor member to provide rotational orientation of said rotor member until said portion is removed; said projecting portion defining a pair of opposed, laterally extending contact members and said second aperture noncircular cross-section including a pair of opposed, straight walls, whereby said rotation is limited by impingement of said contact members against said straight walls, said projecting portion defining a line of breaking weakness to facilitate breaking away of said projecting portion from the outer housing to permit rotation of said rotor member.

7. The interconnector of claim 6 in which said rotor member is capable of rotating at least two complete turns in either direction from a central rotational position when said projecting portion is removed.

8. The interconnector of claim 7 in which said projecting portion is carried at the periphery of said first aperture.

* * * * *